United States Patent [19]

Salomon

[11] 4,066,276

[45] Jan. 3, 1978

[54] SKI BRAKE

[75] Inventor: Georges Pierre Joseph Salomon, Annecy, France

[73] Assignee: S.A. Etablissements Francois Salomon et Fils, Annecy, France

[21] Appl. No.: 669,460

[22] Filed: Mar. 22, 1976

[30] Foreign Application Priority Data

Mar. 25, 1975 France ..... 75.09280

[51] Int. Cl.[2] ..... A63C 7/10

[52] U.S. Cl. ..... 280/605

[58] Field of Search ..... 280/604, 605

[56] References Cited

U.S. PATENT DOCUMENTS

| | | | |
|---|---|---|---|
| 3,899,185 | 8/1975 | Martin | 280/605 |
| 3,992,030 | 11/1976 | Salomon | 280/605 |

FOREIGN PATENT DOCUMENTS

| | | | |
|---|---|---|---|
| 2,228,504 | 12/1974 | France | 280/605 |

*Primary Examiner*—David M. Mitchell

*Attorney, Agent, or Firm*—Haseltine, Lake & Waters

[57] ABSTRACT

A ski brake comprising an elastic system of two springs acting in the same direction on a braking blade wherein one spring is an auxiliary spring of low strength acting alone on the blade until the blade attains a critical intermediate position, the second spring being a main spring of high strength acting on the blade conjointly with the first spring during a portion of the remainder of the travel of the blade from the critical intermediate position to the active position in which the blade is forcibly embedded into the snow.

10 Claims, 14 Drawing Figures

1
2
3
3a
3b
4
5
6
7
8
9
10
11
13

SKI BRAKE

FIELD OF THE INVENTION

The present invention concerns a ski brake, that is to say, an apparatus adapted to prevent a ski from sliding down a slope when, a safety device has been released at the time of a fall, the ski no longer being connected to the skier. One such apparatus therefore replaces the safety straps currently utilized.

BACKGROUND

This apparatus comprises generally at least one arresting arm forming a "blade," pivotally mounted with respect to the ski by means of a hinge. This arm is normally found in an active braking position in which it projects under the bottom of the ski. A pedal articulated to the ski, connected to the arresting arm, extends above the upper surface of the ski and acts in opposition to an elastic member. When pressed towards this surface by the shoe, this pedal moves the arresting arm to an inactive position. In active position of the ski brake, the blade or the arresting arms penetrate more or less into the snow, the ski immobilizing itself on the slope and the skier can easily recover it. The ski therefore does not risk descending the slope and injuring the skier located down the slope or becoming lost.

In order for the ski brake to be effective, it is necessary that the elastic member which activates the blade and makes it pass from its inactive position to its active position, retains a certain state of compression when the blade is in active position. In fact, if this elastic member was totally relaxed, the blade would be pushed back by obstacles and the ski would slide by itself on the slope as if there had not been a blade.

Another solution consists of locking the blade in active position of brakage. This latter solution presents, however, certain disadvantages because, in order for the lockage to take place, it is necessary that the blade attain the locking position corresponding to the maximum travel and furthermore, in active position of brakage, due to the fact that the blade is locked, there is no longer any elastic support of this blade, which increases the risk of breakage of the brake.

The first solution, consisting of utilizing an elastic member strongly stressed in active position, is therefore preferable but is a delicate application as the tension remains very high in inactive position, which leads to, at the time of "step-in" of the boot, forces clearly greater than those which the skier can normally exert. Additionally, and in particular the pedal exerts in the mounted position a force tending to raise the sole and this pressure can disturb the operation of the safety device. Furthermore, preliminary tension of the spring is further elevated and in contrast the force to be exerted by the skier at the time of step-in is increased with increase of the travel of the blade. Finally, certain useful energization apparatus only permits a limited travel.

SUMMARY OF THE INVENTION

The present invention seeks to remedy the disadvantages of the known ski brakes by providing an apparatus of simple conception, only requiring a relatively moderate force at the time of step-in on the ski, to displace the blade of the brake from its active position to its inactive position, while assuring the application to the blade, in active position, of a force sufficiently high with an elastic support of this latter.

To this effect, this ski brake comprises at least one arresting arm forming a blade mounted laterally with respect to the ski and pivotable between an inactive position and an active position in which this blade projects under the ski, elastic means to cause the blade to travel from its inactive position to its active position, and a pedal for boot mounting articulated on the ski above the upper surface thereof and connected to the blade in a manner to displace it to inactive position when the boot is applied on the ski, the brake being characterized in that the elastic means comprises two springs acting in the same direction as the blade, namely a first auxiliary spring, of low tension, acting only on the blade until it attains a critical intermediate position, and a second main spring, of high tension, acting on the blade conjointly with the first at least during a portion of the remainder of the travel from the critical intermediate position up to the active position.

During the first portion of the travel, that is to say, between the inactive position and the critical intermediate position, the main spring is maintained highly stressed practically without exerting a moment of rotation on the blade.

The ski brake according to the invention offers the advantage that it permits assuring an elastic support under a sufficiently elevated force, of the blade in active position, while not requiring too substantial an effort to cause the blade to travel from the active position to the inactive position. This reduction of the necessary force for the travel to inactive position is due to the fact that, at the time of step-in, the main spring is stressed during one singular portion of the travel, that is to say, from the active position to the critical intermediate position, after which only the auxiliary spring is stressed.

BRIEF DESCRIPTION OF THE DRAWING

We will describe hereafter, by way of nonlimitative example, various embodiments of the present invention, with reference to the annexed drawings in which.

DETAILED DESCRIPTION

Figures 1A, 1B, 1C, 1D, 2:
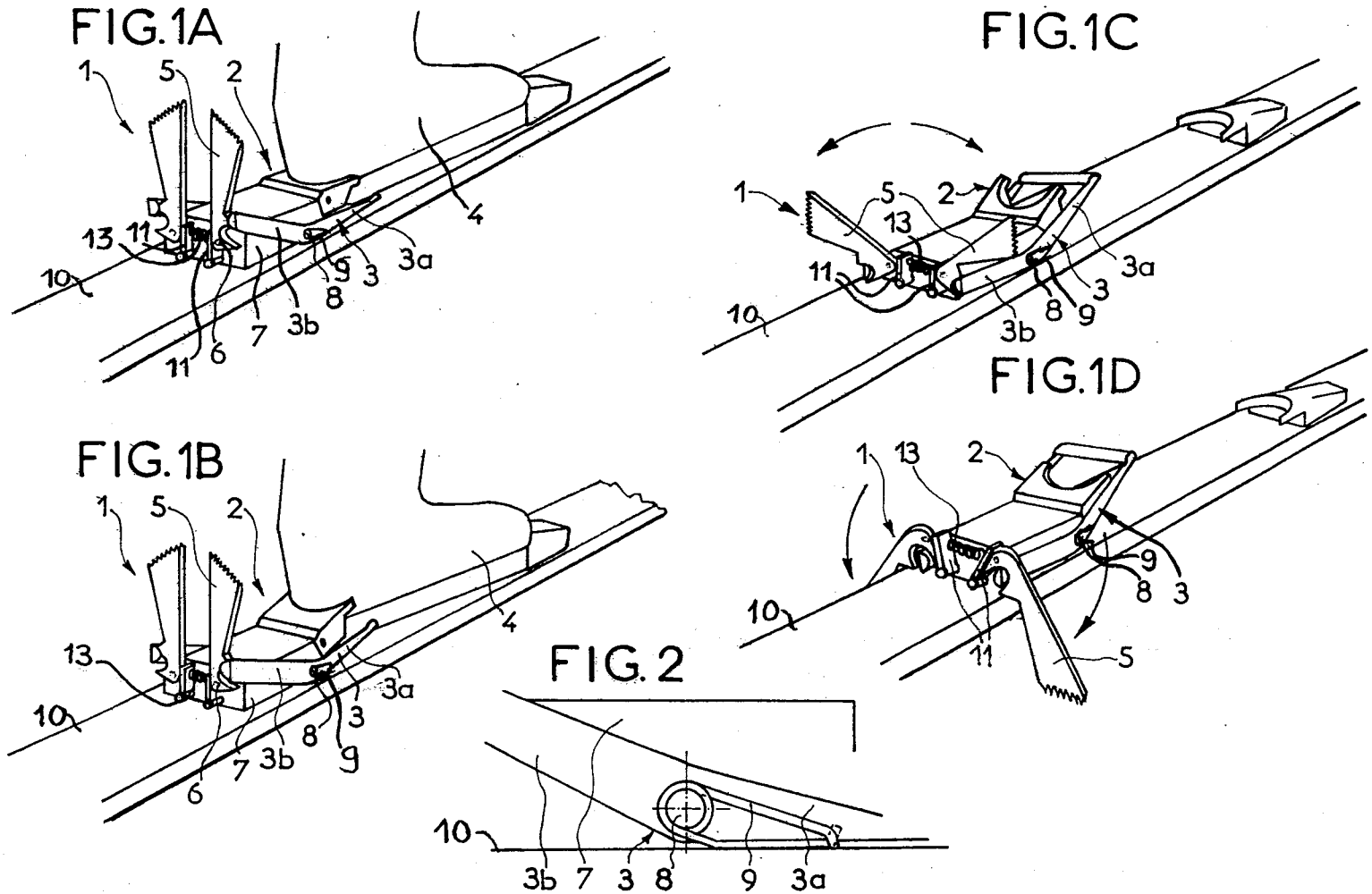
FIGS. 1A, 1B, 1C and 1D are schematic perspective views of a ski brake, according to the invention, in diverse positions which it occupies, respectively, when the device with which it is associated is secured, is in the course of release from this device and after the release.
FIG. 2 is an elevation view on much greater scale of the elastic mechanism acting on the brake pedal.

The ski brake according to the invention, which is represented in FIG. 1A, is designated in totality by 1. This brake which is symmetrical with respect to a median longitudinal plane, is mounted on the upper face of a ski 10 in back of a fixation unit 2, of well-known type, in the form of a heel piece, and it is controlled by a step-on pedal 3 activated by the ski boot 4.

Since the ski brake 1 is symmetrical with respect to a longitudinal plane, we will only describe, with reference to the drawing, one portion of this brake. Each portion of the brake comprises a blade 5 whose extremity is shaped in a suitable manner to allow it to be embedded in the snow. This blade 5 is pivotally mounted around a longitudinal axle 6 at the rear face of a base 7 which can be independent from the fixation unit 2 or from the casing of this latter. The step-on pedal 3 comprises, on each side of the base or casing 7, a bent lever having two arms, i.e. anterior arm 3*a* and posterior arm 3*b*, this lever being articulated around a transverse axle 8. The anterior arms 3*a* of the pedal 3 are connected to one another by a cross piece on which the heel of the ski boot 4 can bear. The lever 3 is urged in counterclockwise direction (FIG. 2) by an auxiliary spring 9 of low tension of any suitable type, for example, a torsion spring encircling axle 8 one branch of which bears on the upper surface of the ski 10 and the other branch of which is bent and engaged under the anterior arm 3*a* of the pedal 3 to raise it.

The posterior arm 3*b* of the pedal 3 acts on the blade 5 at the beginning of the travel from the inactive position (FIG. 1A) in which this blade extends substantially vertically, to the active position (FIG. 1D), in which the blade projects downwardly under the bottom of the ski and at step-in.

Figure 3A:
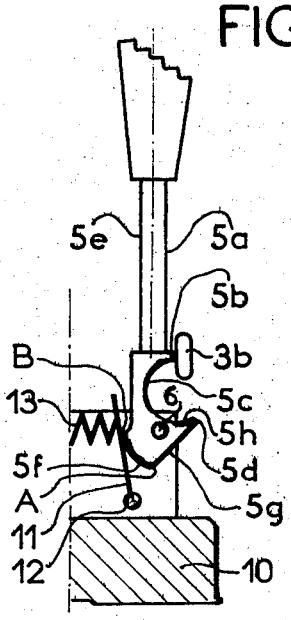
FIGS. 3A, 3B, 3C and 3D, are schematic views in transverse section of a portion of the brake, respectively in the course of the diverse phases of the travel from its inactive position to its active position.

The blade 5 presents on its vertical external edge 5*a*, considered in its inactive position represented in FIG. 3A, and in its lower portion, a boss 5*b* followed by a cam 5*c* oriented toward the base. The internal edge 5*e* of the blade 5 is terminated at its lower portion by a neutral portion 5*f* extending along an arc of a circle AB having as its center the axle 6, and which, at point A, is connected to a cam profile suitably constituted by a flat surface 5*q*, in this example, the distance of the flat surface 5*q* to the center of the axle 6 being less than the radius of the circular arc AB. Finally, there is disposed opposite the cam 5*c* another cam 5*h* oriented upwardly and adapted to cooperate with the arm 3*b* of the pedal. The cams 5*h* and 5*c* situated on the blade are connected by any profile whatsoever. In the illustrated example, these cams are circular portions and the cam 5*h* is connected to the cam 5*q* by a nose 5*d*.

A pivotal plate 11, articulated around a longitudinal axle 12 situated below the axle 6 of the blade 5 and towards the interior with respect to this latter, acts in inactive position of the blades on the profile 5*f*, this pivotal plate being pushed back against the blade 5 by a main compression spring 13 of high tension disposed transversely on the ski.

We will now describe the operation of the ski brake according to the invention with reference to FIGS. 1A to 1D and 3A to 3D which illustrate correlatively and respectively the various phases of the travel of the brake from its inactive position to its active position.

Figure 3B:
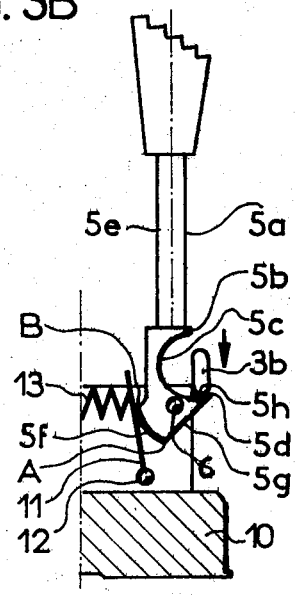

In inactive position, the fixation unit 2 being engaged and the boot 4 flat on the ski 10 (FIG. 1A), the posterior arm 3*b* of the pedal 3 is in contact with the boss 5*b*. If the heel piece 2 pivots slightly upwardly, as is represented in FIG. 1B, in the limits of its elastic vertical travel, due to a slight lifting of the heel of the boot 4 with respect to the ski, the pedal 3 pivots freely around the axle 8 under the action of the auxiliary spring 9 and the posterior arm 3*b* lowers slightly. It can come to occupy a position such as represented in FIG. 3B: in this case, the posterior arm 3*b* frees the boss 5*b* but the blade 5 remains supported in a position of equilibrium by the plate 11 acted on by the spring 13, due to the fact that the force applied by the main spring 13 passes substantially through the center of the pivot axle 6 of the blade 5.

As a consequence, the boot piece can freely travel to a certain degree in the vertical direction without producing the actuation of the brake.

Furthermore, due to the fact that the auxiliary spring 9 is slightly stressed, the skier does not feel practically any opposing force under the heel of his boot since the pedal 3 is weakly urged upwardly.

Figure 3C:
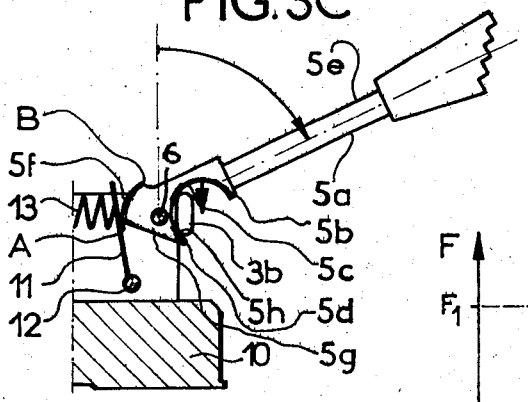

If, following a shock force provoking a release, the boot 4 leaves the ski, the pedal 3 is then totally free and it can pivot further around the axle 8, under the action of the spring 9, the anterior arm 3*a* being raised, and the posterior arm 3*b* being lowered further. In the course of this descending movement, the posterior arm 3*b* contacts the cam 5*h* and causes the blade 5 to pivot clockwise to take it to a critical intermediate position such as illustrated in FIGS. 1C and 3C. During this movement, the plate 11 is supported on the circular arc AB on the neutral profile 5*f* and does not exert any rotation movement on the blade 5 due to the fact that the direction of application of the force of the main spring 13 still passes through the center O of the pivot axle 6 of the blade. In the course of this movement, the only opposing resistance is that due to the friction of the plate 11 on the round neutral profile 5*f*.

Figure 3D:
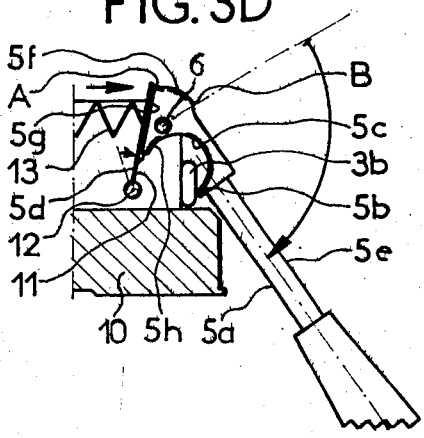

When in the course of pivotal movement of the blade 5, the connecting point A of the neutral rounded profile 5*f* to the profile of cam 5*g* arrives opposite the plate 11 (critical position) and passes this latter, the direction of application of the force of the spring 13 on the blade no longer passes through the center of the pivot axle 6 and this is translated into a moment of force which produces a rocking, essentially instantaneous and rapid, of the blade 5 to its active position shown in FIGS. 1D and 3D in which the plate 11 is placed against the flat surface 5*g*. This rapid movement is due to the release of the main spring 13, which was preliminarily strongly stressed and which remains nevertheless partially stressed in active position, in a manner to prevent the blade from being pushed back by obstacles. In this position (FIG. 3D) we see that the posterior arm 3*b* of the pedal lodges itself against the lateral wall of the casing of the fixation unit and under the cam 5*c*, in a manner so as not to interfere with pivoting of the blade to active position.

We see from the preceding, that in the course of the first phase of activation of the brake, only the auxiliary spring, lightly stressed, acts to produce pivoting of the blade 5 and that in the second part of the movement, it is the main spring 13, strongly stressed, which effects the rocking to active position. Therefore, there is obtained, in a manner of speaking, amplification of force.

At the time of remounting the boot on the ski, the reverse operations are carried out in the following manner: the application of the boot 4 on the ski causes, through the intermediary of the pedal 3, the raising of the posterior arm 3*b* which then causes the blade 5 to pivot from its active position of FIG. 3D in counterclockwise direction to raise it. This movement produces by the action of the pedal of the cam 5*c* progressive compression travel on the main spring 13 until the blade 5 attains the critical intermediate position (FIG. 3C). From this moment on, the stress of main spring 13 no longer increases and it thus remains strongly stressed when the blade 5 attains its vertical inactive position (FIG. 3A) that is to say when the anterior arm 3*a* of the pedal 3 is applied on the ski by the boot. This movement also effects the setting under slight tension of the auxiliary spring 9.

Due to this fact, the necessary work to cause the blade 5 to pass from its active position to its inactive position includes the compression of the main spring 13 only during the first portion of its travel up to the critical intermediate position, and the setting under stress of the auxiliary spring 9. This work is clearly less than that which would be required if the main spring 13 had to be compressed up to the end of the travel to inactive position.

Figure 6:
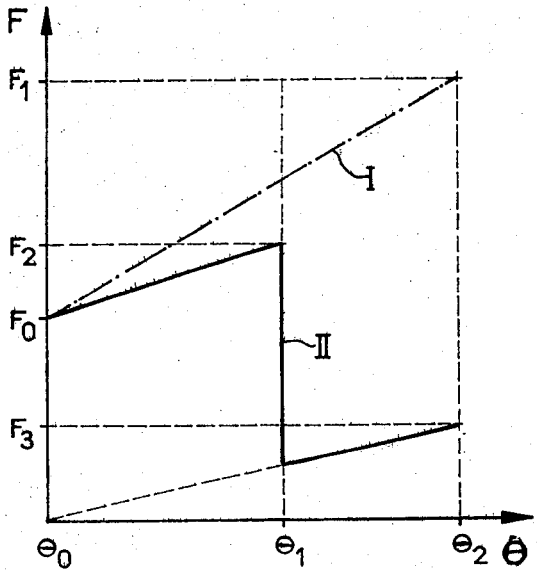
FIG. 6 is a graph illustrating the variation of the force exerted on the pedal, during step-in, as a function of the angle of pivoting of the blade.
Figure 4:
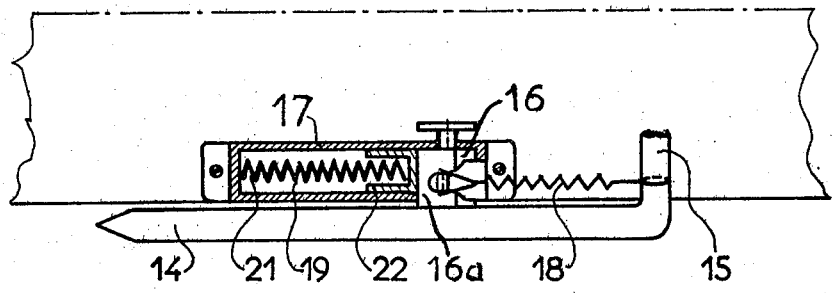
FIG. 4 is a plan view, partially in a horizontal section, of a variant of the portion of the brake.

The graph of FIG. 6 shows the variation of the force F applied during step-in, indicated on the ordinate, as a function of the angle $\theta$ of rotation of the blade indicated on the abscissa. The angles $\theta_0$, $\theta_1$ and $\theta_2$ shown on the abscissa correspond respectively to the active, critical intermediate and inactive positions of the blade. In the graph of FIG. 6 are shown two curves of variation of the force F, namely one curve I in chain dotted lines corresponding to a known brake and a curve II in solid lines corresponding to the brake according to the invention.

In active position (angle $\theta_0$), the blade is subjected to a force $F_0$ sufficiently high to maintain it elastically in this position. In the case of a single energization spring (known brake), the opposing force exerted on the boot, during step-in, increases linearly from the value of $F_0$ to $F_1$ at the end of step-in (curve I).

In contrast, in the case of the brake according to the invention, the force F increases first from the value of $F_0$ up to a greater value $F_2$ when the blade reaches the critical intermediate position (angle of rotation of the blade $\theta_1$), after which this force drops substantially due to the fact that once past the critical position, the opposing force to be overcome is that due to the action of the auxiliary spring 9 and to the friction of the plate 11 against the neutral profile 5*f*. At the end of step-in (inactive position of the blade corresponding to the angle $\theta_2$) the value of the force $F_3$ acting on the boot is clearly less than the value $F_1$ in the case of a known brake, and this for this same force $F_0$ applied on the blade in active position.

Although this is not represented in the drawing, the spring 13 is preferably mounted in a transverse housing permitting it to act simultaneously on the two pivotal plates 11. These latter can be replaced by any other intermediate contact member such as a sliding piston.

We will now describe, with reference to the FIGS. 4, 5A, 5B and 5C, a variant of the embodiment of the brake according to the invention, which is still symmetrical with respect to the median longitudinal plane of the ski. On each side, the brake includes a blade 14 extending laterally with respect to the ski and pivotally mounted around a transverse axle 16. This blade 14 presents, toward the front, a profile assuring its anchorage in the snow and it forms a single piece with a pedal 15 adapted to be acted on by the ski boot. Each lateral arm of the pedal 15 and the associated blade 14 is constituted by a single stem solid with a transverse axle 16 rotatable in a housing of the same shape provided at the interior of a casing 17 fixed on the ski. An auxiliary traction spring 18, of low tension, is hooked, on the one hand, to the pedal 15 and, on the other hand, to the casing 17 in a manner to permanently urge the pedal 15 and the blade 14 in counterclockwise direction, that is to say tending to urge the blade to active position.

Figure 5A:
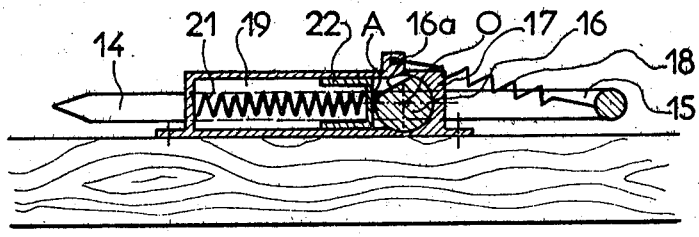
FIGS. 5A, 5B and 5C are schematic views in vertical and in longitudinal section illustrating the operation of the brake according to FIG. 4.
Figure 5B:
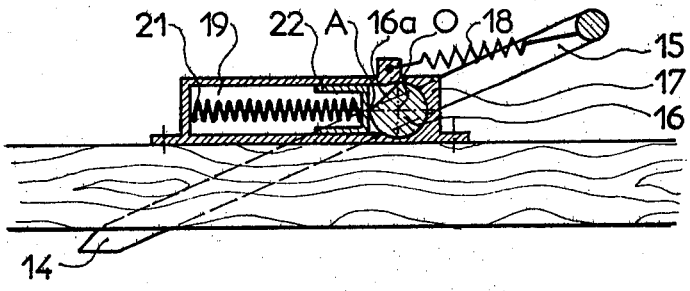
Figure 5C:
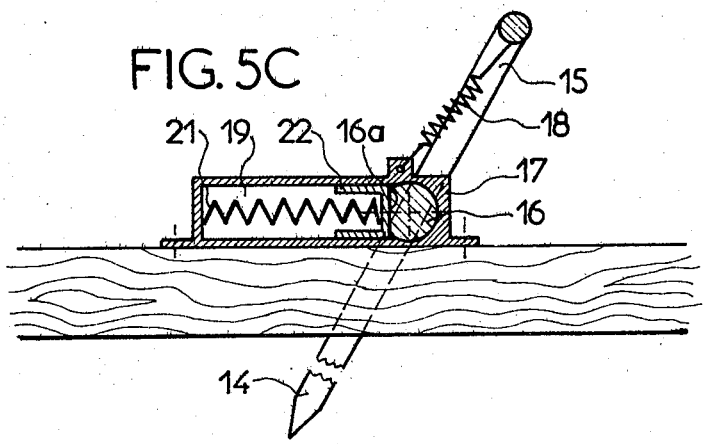

Furthermore, the casing 17 includes a longitudinal housing 19 which opens into the housing receiving the axle 16. Against this axle is placed a piston 22 slidably mounted in the housing 19 and acted on by a main compression spring 21, of high tension, disposed in this housing. The axle 16 has a flat surface 16*a* which is turned towards the housing 19 and which is found substantially in vertical position when the blade 14 is in active position (FIG. 5C).

The operation of this ski brake is the following; when the boot is applied on the ski, the assembly formed by the pedal 15 and the blade 14 is found in substantially horizontal position (FIG. 5A), the pedal 15 being situated under the heel of the boot. The blade 14 extends laterally along the length of the casing 17, above the plane of the ski. In this case, the auxiliary spring 18 is relatively stressed. Furthermore, at the interior of the casing 17, the piston 22 is applied by the spring 21 against the lateral cylindrical surface of the axle 16, constituting a neutral profile and as the direction of the force exerted by the piston passes through the center O of the axle 16 no moment of rotation is exerted on this axle 16.

When the boot leaves the ski, the pedal 15 is freed and under the action of the auxiliary spring 18, the pedal 15 and the blade 14 pivot in the counterclockwise direction. The axle 16 turns in the interior of the casing and at a particular moment, it reaches a critical intermediate position (FIG. 5B) in which the stop A defined at the intersection of the flat surface 16A and the lateral circular surface is found in the direction of the force while being aligned with the center O. Once this critical intermediate position has been passed, the force applied by the main spring 21, through the intermediary of the piston 22, on the stop A of the axle is translated by a moment of rotation which causes pivoting of the blade 14 and the pedal 15 in the counterclockwise direction to take them to the active position shown in FIG. 5*c*. In this position, the piston 22 is placed against the vertical flat surface 16*a* and it is subjected to a certain pressure due to the partially relaxed spring 21. Hence the blade 14 is therefore subjected, in active position, to a certain elastic force and due to this fact, it will resist obstacles that it can contact.

At the time of step-in, the reverse operations are effected. The main spring 21 is compressed during the first portion of the travel up to the critical intermediate position (FIG. 5B), after which its tension no longer varies. In contrast, the auxiliary spring 18 is progressively, but slightly, stressed over the entire course of travel.

In addition to the advantage of having, in inactive position, a low pressure of the pedal under the sole of the boot, the invention also permits utilization of mechanisms such as a piston on a cam plate with greater angular travel than those that they permit alone.

It is obvious that the invention is not limited to the embodiment which has just been described, given by way of purely indicative and non-limitative example, and there could be conceived diverse variations without departing from the framework of the present invention. Thus, the energizations which are achieved through the distinct springs of the pieces in movement could be lodged in these pieces or simply be obtained by elastic deformation of these pieces. Similarly, the axes of rotation could have any inclination with respect to the plane of the ski rather than be parallel to this plane.

What is claimed is:

1. A ski brake mountable on the upper surface of a ski and comprising at least one arresting arm forming a blade, means pivotably mounting the arm on the upper surface of the ski for movement between an inactive position above the ski, and an active position in which said blade projects under the ski, actuator means including an elastic means for causing the blade to travel from its inactive position to its active position, a step-on-pedal, for engagement by a boot, means pivotably supporting the step-on pedal on the upper surface of the ski in a position projecting above the upper surface of the ski and means connecting the step-on pedal with the blade to displace the blade to inactive position when the boot is applied on the ski, said elastic means comprising first and second spring means, and means for transmitting the force of said first and second spring means to said blade, said first spring means including an auxiliary spring of low tension, said force transmitting means transmitting the force of the auxiliary spring on the blade until said blade attains a critical intermediate position between said active and inactive positions, said second spring means including a main spring of high tension, said force transmitting means transmitting the force of the main spring to said blade at a position in which the main spring will not produce rotation of the blade until said blade reaches said critical intermediate position whereafter the force of said main spring is transmitted to the blade at a position to produce rotation of said blade, said force transmitting means transmitting the force of the main spring conjointly with the first spring means at least during a portion of the remainder of the travel from the critical intermediate position to the active position.

2. A ski brake according to claim 1 wherein said actuator means comprises an independent pedal, said pivotably supporting means including first and second arms on opposite sides of the pivotably supporting means, said auxiliary spring being connected to act on said first arm, said second arm being positioned to engage said force transmitting means to cause the blade to attain the critical intermediate position.

3. A ski brake according to claim 2 wherein said pivotably mounting means provides a longitudinal pivotal axis and is located behind the pedal, said force transmitting means includes an external edge on said blade which is provided at a lower portion thereof with a cam above which extends, in inactive position, the second arm of said pedal such that the pedal is urged by the auxiliary spring in a direction to cause the second arm to bear against said cam of the blade to pivot the blade towards said critical intermediate position.

4. A ski brake according to claim 3 wherein said blade has on said external edge a second cam situated above the first cam and a terminal boss above said second cam, said second arm of the pedal coming to rest under said second cam when the blade is lowered to said active position.

5. A ski brake according to claim 3 wherein said blade has an internal edge with a lower portion of circular arc shape having a center coinciding with the center of the pivotal axis of said blade, a further cam provided at the lower portion of said interior edge of said blade, said further cam being connected to said circular arc shape portion, and a plate pivotably mounted on a longitudinal axis situated below the pivot axis of said blade and offset transversely inwards, said pivotal plate being urged into contact with said internal edge by said main spring.

6. A ski according to claim 5 wherein said further cam is constituted by a flat surface.

7. A ski brake according to claim 5 comprising two of said pivotal plates disposed symmetrically with respect to a median longitudinal plane of symmetry of the ski, said main spring acting on two of said pivotal plates, each acting on a respective blade.

8. A ski brake according to claim 1 wherein said force transmitting means for said auxiliary spring comprises a direct connection of said auxiliary spring to said blade, said pivotably mounting means comprises a turnable axle secured to said blade, a casing on said ski rotatably receiving said axle, and wherein said force transmitting means for said main spring comprises a cam surface on said axle, said main spring acting on said cam surface.

9. A ski brake according to claim 8 wherein said blade is integral with said step-on pedal, said auxiliary spring operating in tension and connected at one end to said pedal and at the other end to said casing.

10. A ski brake according to claim 9 wherein said main spring extends longitudinally in said casing and faces said transverse axle, a sliding piston in said housing bearing against said axle and receiving the thrust of said main spring, said axle having a flat surface against which said piston is urged by said main spring when said blade is in active position.

* * * * *